United States Patent [19]

Bofinger et al.

[11] Patent Number: 5,027,767

[45] Date of Patent: Jul. 2, 1991

[54] FUEL INJECTION PUMP FOR INTERNAL COMBUSTION ENGINES

[75] Inventors: Guenter Bofinger, Vaihingen/Enz; Claus Maier, Ludigsburg-Poppenweiler, both of Fed. Rep. of Germany

[73] Assignee: Robert Bosch GmbH, Stuttgart, Fed. Rep. of Germany

[21] Appl. No.: 399,191

[22] Filed: Aug. 28, 1989

[30] Foreign Application Priority Data

Sep. 2, 1988 [DE] Fed. Rep. of Germany ..... 3829798

[51] Int. Cl.[5] ..... F02D 31/00

[52] U.S. Cl. ..... 123/373; 123/374; 123/503

[58] Field of Search ..... 123/373, 449, 503, 365–372, 123/374

[56] References Cited

U.S. PATENT DOCUMENTS

| | | | |
|---|---|---|---|
| 3,200,802 | 8/1965 | Dluhosch | 123/373 |
| 3,759,236 | 9/1973 | Staudt | 123/373 |
| 3,791,361 | 2/1974 | Hofmann | 123/373 |
| 4,478,746 | 3/1984 | Greiner | 123/373 |
| 4,621,601 | 11/1986 | Kupzik | 123/374 |
| 4,664,079 | 5/1987 | Sakuranaka | 123/373 |
| 4,665,873 | 5/1987 | Yogome | 123/373 |
| 4,884,542 | 12/1989 | Konrath | 123/373 |

*Primary Examiner*—Carl Stuart Miller

*Attorney, Agent, or Firm*—Edwin E. Greigg

[57] ABSTRACT

A fuel injection pump including a housing having an adjustable coupling device on the outside of the housing by which the speed governor can be adjusted from outside the housing of the fuel injection pump. By use of the adjustable coupling device on the outside of the housing, it is possible to eliminate production-oriented parts tolerances by means of adjustments of the speed governor, without tampering with its internal conditions.

4 Claims, 3 Drawing Sheets

1
2
X
38
42
28
40
1
2
αi2
αi1
αi1'
16
18
A
B

FUEL INJECTION PUMP FOR INTERNAL COMBUSTION ENGINES

BACKGROUND OF THE INVENTION

The invention is based on a fuel injection pump for internal combustion engines. In a fuel injection pump of this type, set forth in U.S. Pat. No. 4,621,601, an arbitrary adjustment of the gas pedal leads to a change in the setting of a speed governor; there is a nonlinear relationship between the arbitrary adjustment and the extent of intervention upon the speed governor, so as to be able to accelerate or slow down a vehicle without bucking. A coupling device is located upon the speed governor, for instance at a governor spring.

In setting the idling or setting of the remaining fuel quantity, variations in tolerances in terms of the length of the elements involved in this transmission path cause a shift in the idling position in the fuel injection pump and hence result in "good" or "poor" fuel injection pump governors.

OBJECT AND SUMMARY OF THE INVENTION

The fuel injection pump according to the invention has an advantage over the prior art that variations in tolerance of the lengths of all the elements in the transfer path between an arbitrary adjustment and the intervention upon the governor can be eliminated in terms of the idling or remaining fuel quantity settings. This elimination affects neither the progressive change in fuel quantity as a function of the adjusting lever nor the intended vehicle ride during acceleration. Maximum uniformity in the vehicle ride is thus attained with respect to partial-load and acceleration bucking. The invention is applicable to various types of speed governor, whose characteristic control performance graph remains unchanged. Further advantageous features of the fuel injection pump disclosed in the main claim are attainable by the provisions recited in the dependent claims.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
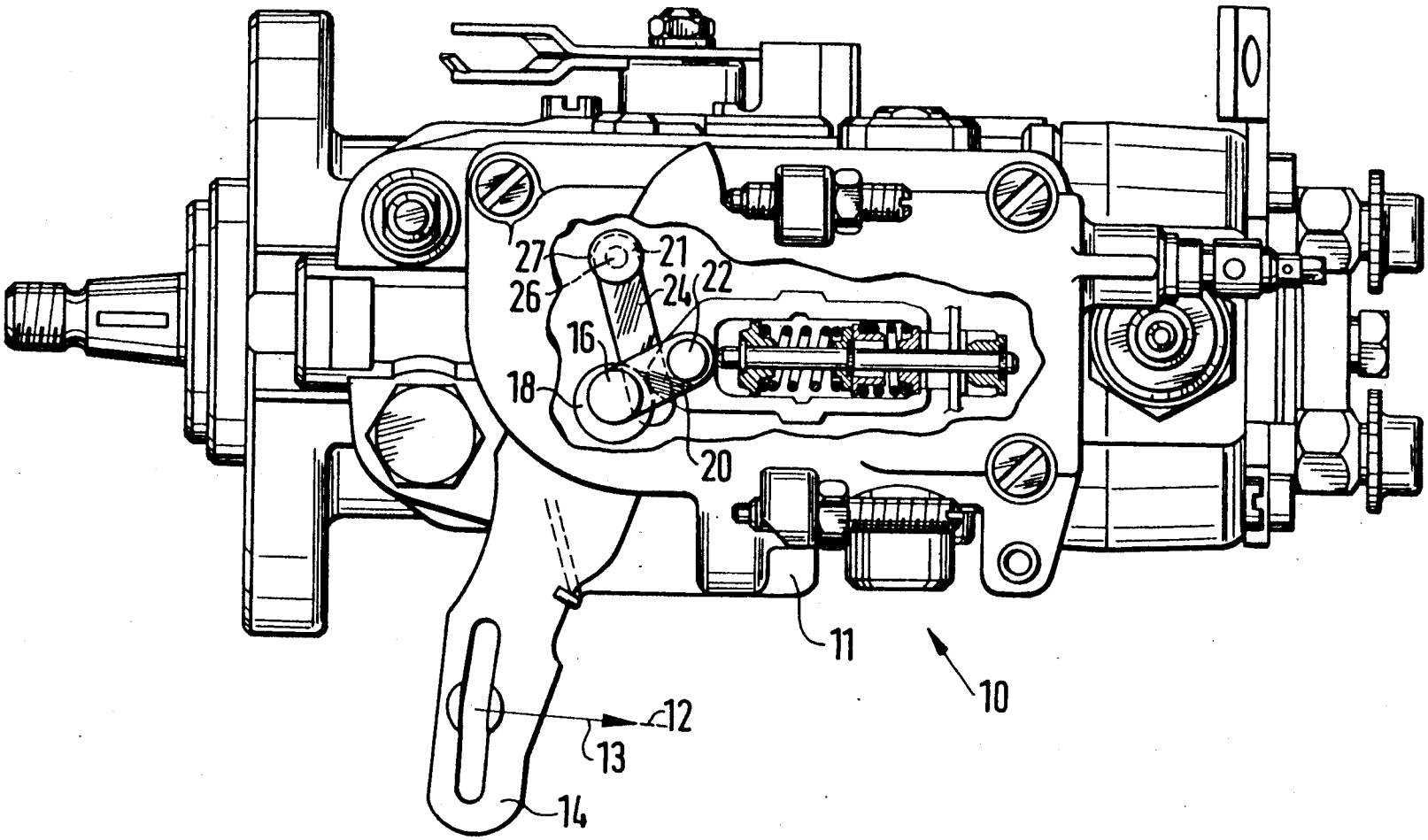
FIG. 1 is a partial longitudinal section through a fuel injection pump.

FIG. 1 shows an adjusting lever arrangement for actuating a fuel injection quantity adjusting device of a distributor type of fuel injection pump 10, known per se and hence not shown in detail here, in an internal combustion engine. A driving pedal, not shown, is connected via a Bowden cable 12 to an adjusting lever 14, which is fixedly secured to an adjusting lever shaft 16. The adjusting lever shaft 16 is guided by a first eccentric bushing 18 that surrounds it which is supported in a housing 11 of the pump. The shaft 16 has a lever arm 20, rigidly coupled to it, which on its end remote from the shaft 16 has a slide block 22 protruding transversely to the pivot axis of the lever arm 20. The slide block 22, shown here in the form of a round bolt, rests on the outer contour 25 of a slide rail 24. The lever arm 20, slide block 22 and slide rail 24 together form a coupling device. The slide rail 24, here in the form of an elongated lever with an outer contour 25 that in the functional portion is straight but may also be embodied as a curved path, is rotatably supported at a first end 21 on a shaft 26, which is guided in a bushing 27 that centrally surrounds the shaft.

Figure 2:
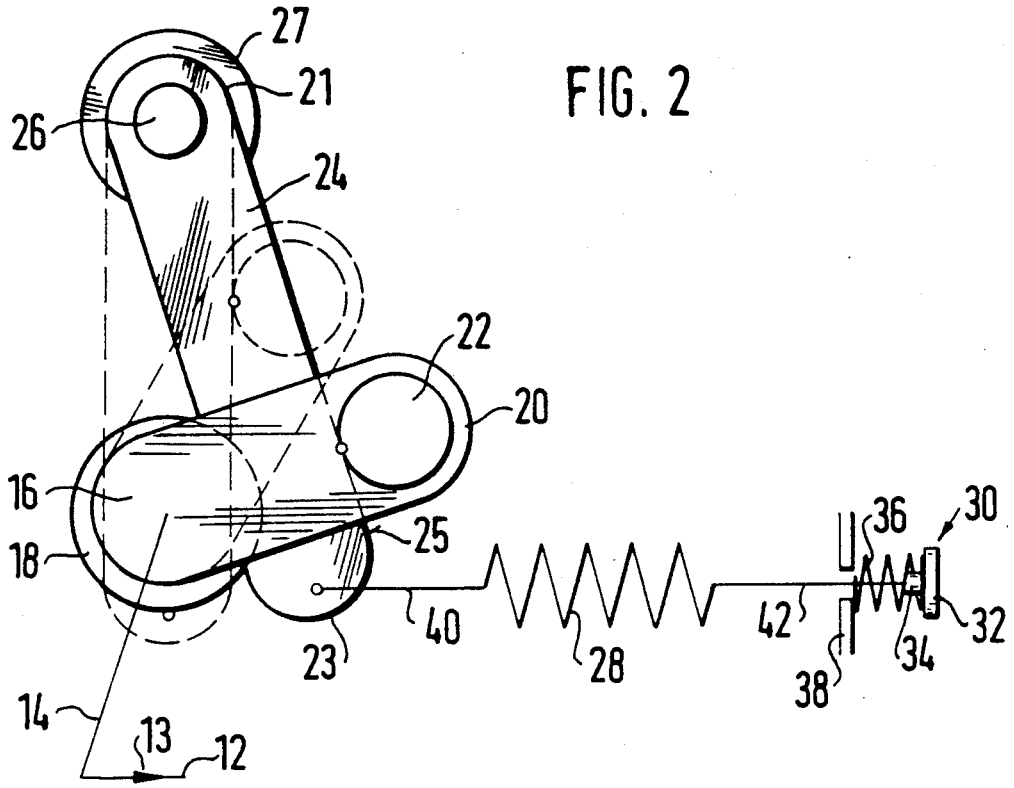
FIG. 2 is a more-detailed view of the first exemplary embodiment.

As shown in FIG. 2, the second end 23 of the slide rail 24 is connected to an adjusting member 28 of the speed governor, shown only symbolically, of the fuel injection pump 10. The adjusting member 28, in the form of a governor spring, is secured via a first end 40 to the second end 23 of the slide rail 24, and at its end remote to the slide rail 24, that is, a second end 42, it is connected to a retaining bolt 30. The retaining bolt comprises a truncated circular cone 34 having a collar 32, and via this cone 34 centers an intermediate spring 36 supported at one end on the collar 32 and at the other end pressing against a governor or tensioning lever 38. The governor lever 38 is connected to a fuel injection quantity metering device, not shown, in a known manner.

Figure 3:
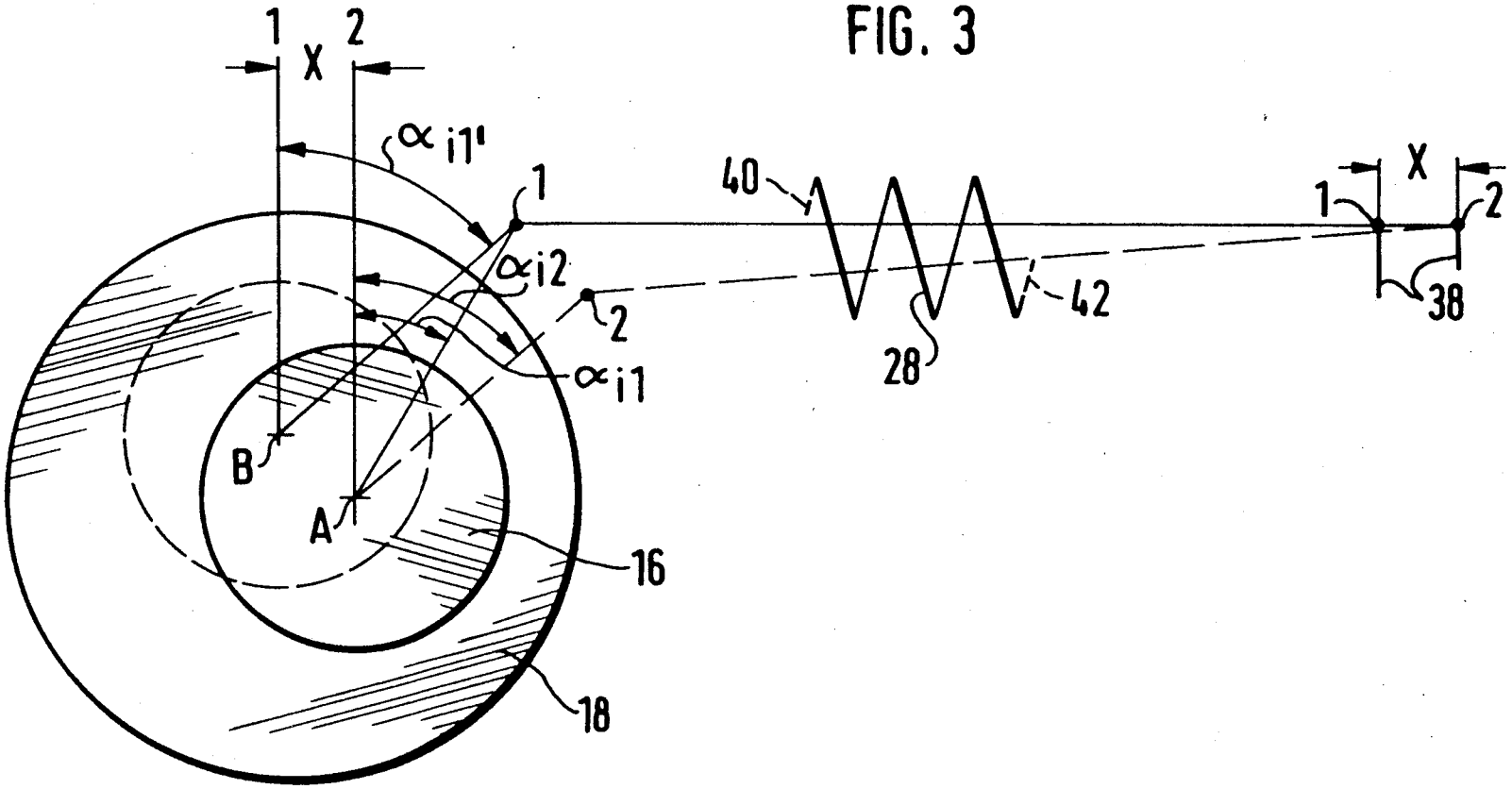
FIG. 3 is a schematic illustration of the first exemplary embodiment, emphasizing the geometric events in the adjustment according to the invention of the adjusting lever shaft.

FIG. 3 shows the adjusting lever shaft 16 in two different positions inside the eccentric bushing 18 guiding it. In an initial position, the center of the shaft 16 assumes the position A; in another position, it assumes the position B. The horizontal component of the distance between A and B is marked X. The connection from the center of the shaft 16 to the tensioning lever 38 is schematically represented with the symbolically shown governor spring as the adjusting member 28. The first end 40 thereof, oriented toward the adjusting lever shaft 16, assumes a position 1 in the initial position and a position 2 in the other position. The end of the adjusting member 28 adjacent the retaining bolt 30, that is, the second end 42, keeps the tensioning lever 38 in position 1 in the initial position and in position 2 in the other position; the horizontal distance between positions 1 and 2 is again marked X.

Figure 4:
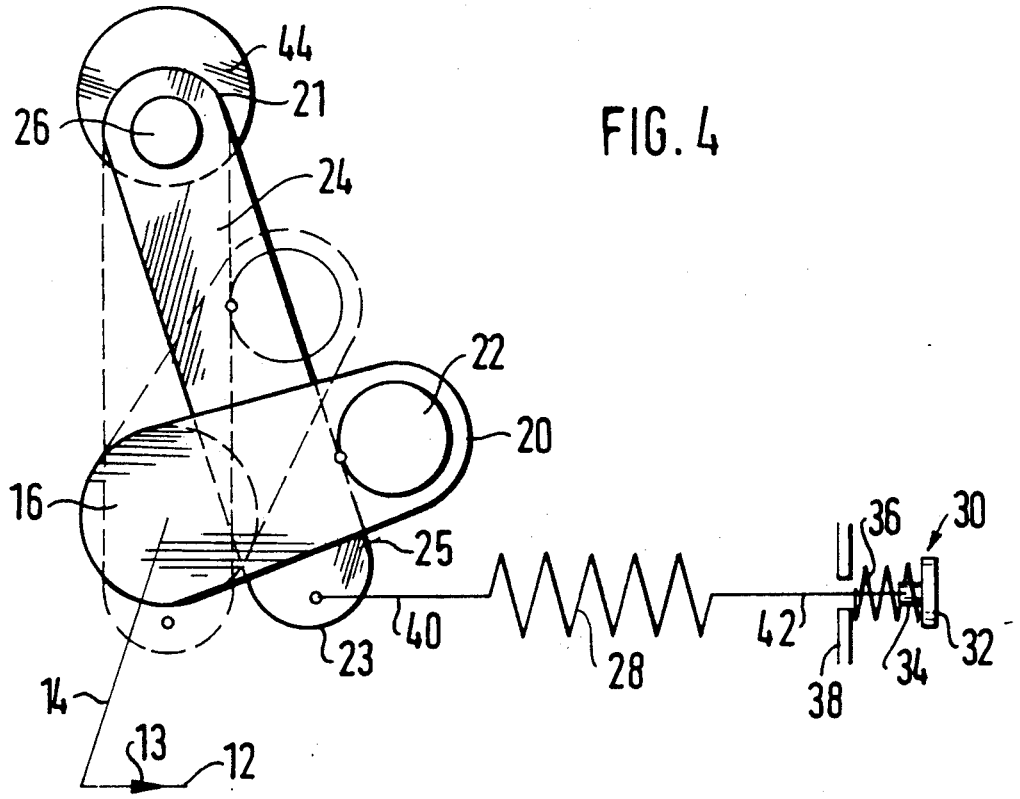
FIG. 4 shows a second exemplary embodiment with the shaft adjustment according to the invention.

A structural variant of the version shown in FIG. 2 is shown in FIG. 4. The adjusting lever shaft 16 is changed in this version; it is now supported directly in the housing 11 of the fuel injection pump, and the shaft 26 is also changed, now being surrounded and guided by a second eccentric bushing 44, which is supported in the housing 11 of the fuel injection pump.

With the above-described apparatus, the course of events in its function is as follows: Beginning at the operating state of idling, if torque is demanded of the engine and the Bowden cable 12 adjusts in the direction of the arrow 13 for an increased fuel quantity, the adjusting lever 14 connected to the Bowden cable 12 follows up this motion, by pivoting about the center of the adjusting lever shaft 16. The adjusting lever shaft 16, rigidly coupled to the adjusting lever 14, participates in the pivoting and in turn moves the lever arm 20 firmly seated on it. The slide block 22 attached to the lever arm 20 transfers the pivoting motion to the slide rail 24, by sliding along the outer contour 25 thereof. This causes the slide rail 24 to take over the motion; it pivots about the shaft 26 in turn, counter to the force of the adjusting member 28 and intermediate spring 36, or counter to the adjusting force brought to bear via the governor lever 38 of the speed governor, which is known and hence not shown in further detail here. Via the adjusting member 28, the retaining bolt 30 and the intermediate spring 36, this leads to a change in position of the governor lever 38 and in a known manner leads to an adjustment of the fuel injection quantity metering device, or to a change in the controlling tension of the governor spring 28 or intermediate spring 36.

An adjusting lever arrangement exhibits the above-described kinematics in that with an unchanged total adjustment path of the adjusting lever 14, a division of the fuel injection quantity takes place, such that in the first portion of the adjusting lever path, the change in fuel injection quantity is slight, from the lower idling range in the direction of higher rpm; in the second portion of the adjusting lever path, contrarily, the change in fuel injection quantity becomes greater, and as a result the ride of the vehicle is favorably varied with this progressive articulation of the adjusting lever.

The functional course of events results in the following course of operation: Production-oriented tolerances in the parts embodying the elements of the above-described kinematics lead to different positions for the position of the governor lever 38 representing the idling position of the fuel injection pump 10 and hence to different metered fuel quantities for that operating state. The following discussion takes the final tolerance positions and the positions assumed here by the governor lever 38 as the point of departure.

As shown in FIG. 3, in the initial position the governor lever 38 assumes position 1, and in the other position it assumes position 2. The two positions 1 and 2 are transferred to the adjusting member 28, which is only schematically shown, by means of the intermedaite spring 36 and the retaining bolt 30, which are no longer shown at all. The adjusting member 28, along with the first end of the spring 40, oriented toward the adjusting lever shaft 16, likewise defines the positions 1 and 2. The connection between this position 1 and position 2, respectively, and the center of the adjusting lever shaft 16, which in the initial position assumes a position A, forms an angle $\alpha_{il}$ and an angle $\alpha_{i2}$, respectively, with the vertical in position A. The angle $\alpha_{il}$ is smaller than the angle $\alpha_{i2}$. A rotation of the first eccentric bushing 18 that eccentrically surrounds the adjusting lever shaft 16 shifts this shaft 16. If the rotation of the first eccentric bushing 18 is counterclockwise, and if the center of the adjusting lever shaft 16 attains point B, then the angle $\alpha_{ir}$, formed in the same manner as the angle $\alpha_{il}$, is the same size as the angle $\alpha_{i2}$. Equal angles, that is, $\alpha_{ir}=\alpha_{i2}$, signify the shift of the adjusting member 28 from position 2 to position 1, yet without any change in the transfer behavior of the governor spring, represented by the adjusting member 28, when the adjusting lever 14 is deflected by the Bowden cable 12. The shift from position 2 to position 1 in response to the rotation of the first eccentric bushing 18 further causes a displacement at the governor lever 38, the horizontal component of which is denoted by the dimension X, which is the amount of tolerance to be compensated for. This dimension X likewise occurs at the adjusting lever shaft 16, in the form of the horizontally oriented component of the distance between the two centers in positions A and B. Equal horizontal shifts occur for the adjusting member 28, one at the governor lever 38 and the other at the adjusting lever shaft 16, a shift of the adjusting member 28 from the other position 2 to the initial position 1, is in such a direction that the basic tension of the adjusting member 28 remains the same, and the progressive adjusting lever arrangement is unchanged in its operation.

In summary, by means of the rotation of the eccentric bushing 18, an adjustment that is performable outside the housing 11 of the fuel injection pump 10 and can be fixed by means not shown becomes possible, which has the effect of eliminating production-oriented tolerances in those parts of the speed governor of the fuel injection pump 10 that have an influence on the fuel quantity metered in the idling state, without changing the governing behavior of the governor itself.

Alternatively, as shown in FIG. 4, the shaft 26 could be guided in a second eccentric bushing 44; the first eccentric bushing 18 supporting the adjusting lever shaft 16 could be omitted if desired.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having a housing, a fuel injection quantity governor and an adjusting lever (14), said adjusting lever is arbitrarily actuated to specify a set-point variable and is pivotable with an adjusting lever shaft, a lever arm (20) rigidly secured to said adjusting lever shaft (16), said lever arm (20) rests on a curved path located on a coupling device, said coupling device is pivotable about a shaft (26) and one end is connected to an adjusting member (28) of said fuel injection quantity governor, the position of said shaft (26) and said adjusting lever shaft (16) relative to one another is adjustable and fixable for controlling said coupling device for adjustment of the fuel injection quantity governor.

2. A fuel injection pump as defined by claim 1, in which said shaft (26) and said adjusting lever shaft (16) is adjustably supported in the housing (11) of the fuel injection pump (10).

3. A fuel injection pump as defined by claim 1, in which said shaft (26) and said adjusting lever shaft (16) are each supported in an adjustable eccentric bushing (18, 44).

4. A fuel injection pump as defined by claim 2, in which said shaft (26) and said adjusting lever shaft (16) are each supported in an adjustable eccentric bushing (18, 44).

* * * * *